US005302092A

United States Patent [19]

Tsutahara et al.

[11] Patent Number: 5,302,092

[45] Date of Patent: Apr. 12, 1994

[54] FLUID TRANSFERRING APPARATUS IMITATING FLAPPING MOVEMENT OF BEES

[75] Inventors: Mishihisa Tsutahara, Osaka; Takeyoshi Kimura, Takarazuka; Yasunori Okamoto; Toru Iwata, both of Sakai, Japan

[73] Assignee: Daikin Industries, Ltd., Osaka, Japan

[21] Appl. No.: 894,271

[22] Filed: Jun. 4, 1992

[30] Foreign Application Priority Data

Jun. 7, 1991 [JP] Japan ..... 3-136704

[51] Int. Cl.[5] ..... F04B 19/00

[52] U.S. Cl. ..... 417/436

[58] Field of Search ..... 417/436; 415/211.2, 415/125

[56] References Cited

U.S. PATENT DOCUMENTS

| | | | |
|---|---|---|---|
| 12,190 | 1/1855 | De Bergue | 417/436 |
| 1,601,246 | 9/1926 | Frost . | |
| 2,728,298 | 12/1955 | Shafer | 417/436 |
| 3,048,141 | 8/1967 | Fisk . | |

FOREIGN PATENT DOCUMENTS

| | | | |
|---|---|---|---|
| 43877 | 1/1982 | European Pat. Off. . | |
| 153810 | 2/1903 | Fed. Rep. of Germany . | |
| 0153810 | 2/1903 | Fed. Rep. of Germany . | |
| 1728084 | 3/1972 | Fed. Rep. of Germany . | |
| 2446964 | 4/1976 | Fed. Rep. of Germany . | |
| 844617 | 7/1939 | France . | |
| 1418806 | 12/1965 | France . | |
| 1472317 | 3/1967 | France . | |
| 0600768 | 12/1959 | Italy | 417/436 |
| 1-107000 | 4/1989 | Japan . | |
| 3-160200 | 7/1990 | Japan . | |
| 0289372 | 7/1953 | Switzerland | 417/436 |
| 493363 | 8/1970 | Switzerland . | |
| 9600 | of 1913 | United Kingdom . | |
| 0009600 | 2/1914 | United Kingdom . | |
| 157381 | 5/1922 | United Kingdom . | |
| 0157381 | 6/1922 | United Kingdom . | |
| 0588953 | 3/1945 | United Kingdom . | |
| 588953 | 6/1947 | United Kingdom . | |
| 1577582 | 10/1980 | United Kingdom | 417/436 |

*Primary Examiner*—Richard A. Bertsch
*Assistant Examiner*—Charles G. Freay

[57] ABSTRACT

A fluid transferring apparatus achieves a two-dimensional flow of fluid with high efficiency and at low noise by imitating a Weis-Fogh mechanism with use of a simple mechanism. In the fluid transferring apparatus, a wing assembly X comprised of a predetermined number of plate-like wings is provided in a transverse direction of a flow passage. A wing assembly X is supported by a link of a crank mechanism which is constituted of a crank rotated by a motor, a slider slidable in a direction orthogonal to a direction of a flow in a flow passage and the link coupling the crank with the slider, so that rotational motion of the crank is transmitted to the slider as a reciprocal movement. While an angle of attack of each wing is changed by oscillating action of the link, each wing is moved in a transverse direction of the flow passage as the link is reciprocated, thereby achieving transfer of fluid.

16 Claims, 17 Drawing Sheets

FLUID TRANSFERRING APPARATUS IMITATING FLAPPING MOVEMENT OF BEES

BACKGROUND OF THE INVENTION

1. Field of the Invention

The present invention relates to a fluid transferring apparatus which transfers fluid with use of reciprocal motion of wings in a transverse direction in a flow passage, in a manner like the flapping movement of bees.

2. Description of the Prior Art

A cross flow fan has conventionally been used, for example, in many air conditioners as a fluid transferring apparatus to realize a two-dimensional flow. In comparison with a propeller fan, a sirocco fan, etc. which achieves a three-dimensional flow, however, the cross flow fan is disadvantageous in its low efficiency and restrictions on design. That is, although it is effective to enlarge the diameter of a fan in order to reduce noises, a large space is necessitated therefor and a shape, of a scroll part, a stabilizer or the like greatly influences the efficiency of the cross flow fan.

Therefore, a fluid transferring apparatus of a perfectly new type has been desired and a proposal for utilization of a so-called Weis-Fogh mechanism, e.g., as disclosed in Japanese Patent Laid-open Publication 64-107000 has been made to realize a two-dimensional flow with high efficiency and reduced noises.

In the meantime, the Weis-Fogh mechanism referred to above utilizes a new propelling method discovered when the flapping of bees is observed. As indicated in the above-mentioned prior art as well, according to the Weis-Fogh mechanism, two wings are provided within a flow passage and moved in parallel to each other in a manner to alternately be brought close and separated in a direction orthogonal to the flow passage, while an attack angle of each wing is changed at both ends of its stroke.

However, a driving mechanism would be considerably complicate and hard to operate at high speeds if the wings were driven by mechanical means strictly in compliance with the Weis-Fogh mechanism. Therefore, no suitable example of an actual application of the Weis-Fogh mechanism has been embodied so far, and the above prior art also does not clearly disclose a concrete driving mechanism, thus calling for a technique enabling realization of the Weis-Fogh mechanism in a simple manner.

SUMMARY OF THE INVENTION

The object of the present invention is therefore to provide a fluid transferring apparatus which, realizing the Weis-Fogh mechanism by a mechanism simple in structure and able to operate at high speeds, achieves a two-dimensional flow with high efficiency and with reduced noises.

In order to accomplish the above-described object, there is provided a fluid transferring apparatus which comprises:

a casing defining a flow passage of fluid;

a wing assembly having at least one wing provided in a transverse direction of the flow passage; and a driving mechanism for moving the wing in a manner similar to when bees are flapping.

It is preferable that the casing and the flow passage are rectangular in cross section.

Further, it is preferable that the driving mechanism is provided in the vicinity of the casing and in a peripheral section of the flow passage.

Furthermore, it is preferable that the driving mechanism is a crank mechanism consisting of a rotating crank, a crank pin, a guide member extending in a transverse direction of the flow passage, a slider guided by the guide member to slide in a transverse direction of the flow passage, and a link having one end thereof rotatably coupled to the crank pin and the other end thereof rotatably coupled by a pin to the slider, and the wing of the wing assembly is mounted to the link of the crank mechanism.

With the above structure, the link is reciprocated in a direction approximately orthogonal to the flow passage while an inclining angle of the link is continuously changed as the crank is rotated by a motor, for example. Accordingly, the wing is reciprocated in a direction transverse to the flow passage from a top dead point to a bottom dead point while an inclining angle of the wing (namely, an attack angle) to the flow in the flow passage is continuously changed as the crank is rotated, whereby the fluid is transferred by the surface of the wing, that is to say, the air is supplied in a blower.

Thus, a pseudo Weis-Fogh mechanism is presented in the fluid transferring apparatus of the present invention, and therefore a two-dimensional flow can be positively and easily obtained with high efficiency and low noise. At the same time, since the crank mechanism itself is simple in structure and able to work at high speeds, it is easily applied to an actual transferring apparatus. Moreover, the transferring direction of a fluid can be changed with ease by controlling the rotational phase of the crank mechanism. Therefore, it is highly effective particularly when the fluid transferring apparatus of the present invention is applied to an air conditioner fan.

Further, it is preferable that the wing of the wing assembly is fixed to the link.

Further, it is preferable that the wing assembly has a plurality of wings which are parallel to each other and are fixed to the link.

Furthermore, it is preferable that the wing is formed of flexible material, a front end of which is fixed to the link.

Further, it is preferable that a front end of the wing is rotatably mounted to the link in a manner that a predetermined force is necessary to rotate the wing to the link.

Further, it is preferable that a front end of the wing is rotatably mounted to the link by a pin, while a rear end of the wing is coupled to the link by a spring, thereby controlling an angle of attack of the wing.

Moreover, it is preferable that a front end of the wing is rotatably mounted to the link by a pin, while a rear end of the wing is coupled to the link by a leader, thereby controlling an angle of attack of the wing.

Further, it is preferable that a plurality of units each comprised of the crank mechanism and wing assembly are provided at both the upstream and the downstream sides of the flow passage, with rotational phase angles being made different among the cranks of the crank mechanisms in the plurality of units when the cranks are driven.

With the above structure, a plurality of wing assemblies different in the operating phase are provided in the front of and in the rear of the flow passage, so that pulsation of transferring fluid can be restricted as much as possible, with a higher static pressure ensured, in comparison with the case where a single wing assembly is used. As a result, the fluid is transferred more stably with improved efficiency.

Further, it is preferable that a plurality of units each comprised of the crank mechanism and wing assembly are provided in a transverse direction of the flow passage.

Further, it is preferable that the units adjacent to each other are arranged in symmetric relation and driven in reverse rotational phase.

Further, it is preferable that the driving mechanism is a crank mechanism consisting of a rotating link, a crank pin, a first link rotatably mounted at a fulcrum and a second link having one end thereof rotatably mounted to the crank pin and the other end thereof rotatably mounted to an end of the first link by a pin, and wherein the wing of the wing assembly is mounted to the second link.

Moreover, it is preferable that the driving mechanism includes a swinging lever mounted to a shaft extending in a direction to traverse the flow passage, and wherein a front end of the wing of the wing assembly is mounted to the lever.

Further, it is preferable that the front end of the wing is mounted to the lever in a rotatable manner.

Further, it is preferable that a rear end of the wing is coupled to the lever with a spring, thereby controlling an angle of attack of the wing.

Further, it is preferable that a rear end of the wing is coupled to the lever by a leader, thereby controlling an angle of attack of the wing.

Furthermore, it is preferable that the wing is formed of flexible material.

Further, it is preferable that the wing is formed of flexible material and mounted to the lever in a non-rotatable manner, with the wing extending along a center line of the lever in the natural state.

Further, it is preferable that a central part of the lever is swingably mounted to the shaft, with front ends of the wings being mounted to either end of the lever.

Further, it is preferable that the wings are formed of flexible material and have a front end fixed to either end of the lever, and the wings extend along a center line of the lever, with a rear end directed in a downstream direction of the flow passage in the natural state.

Further, it is preferable that the lever is a T-shaped figure having a projecting part which projects from a central part of the lever, and wherein the driving mechanism is a crank mechanism consisting of the T-shaped lever, a rotating crank, a crank pin, and a link having one end thereof rotatably mounted to the crank pin and the other end thereof rotatably mounted to an end of the projecting part by a pin.

Furthermore, it is preferable that the driving mechanism is a crank mechanism consisting of the lever, a crank, a crank pin and a link having one end thereof rotatably mounted to the crank pin and the other end thereof rotatably mounted to the lever by a pin.

Further, it is preferable that the other end of the link is rotatably mounted to an end of the lever where the wing is mounted.

Further, it is preferable that a groove is formed in the lever, and the driving mechanism is a crank mechanism consisting of the lever, a rotating crank, and a crank pin sliding in the groove of the lever.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Now, a fluid transferring apparatus according to preferred embodiments of the present invention will be discussed in detail with reference to the accompanying drawings.

First Embodiment

Figure 1:
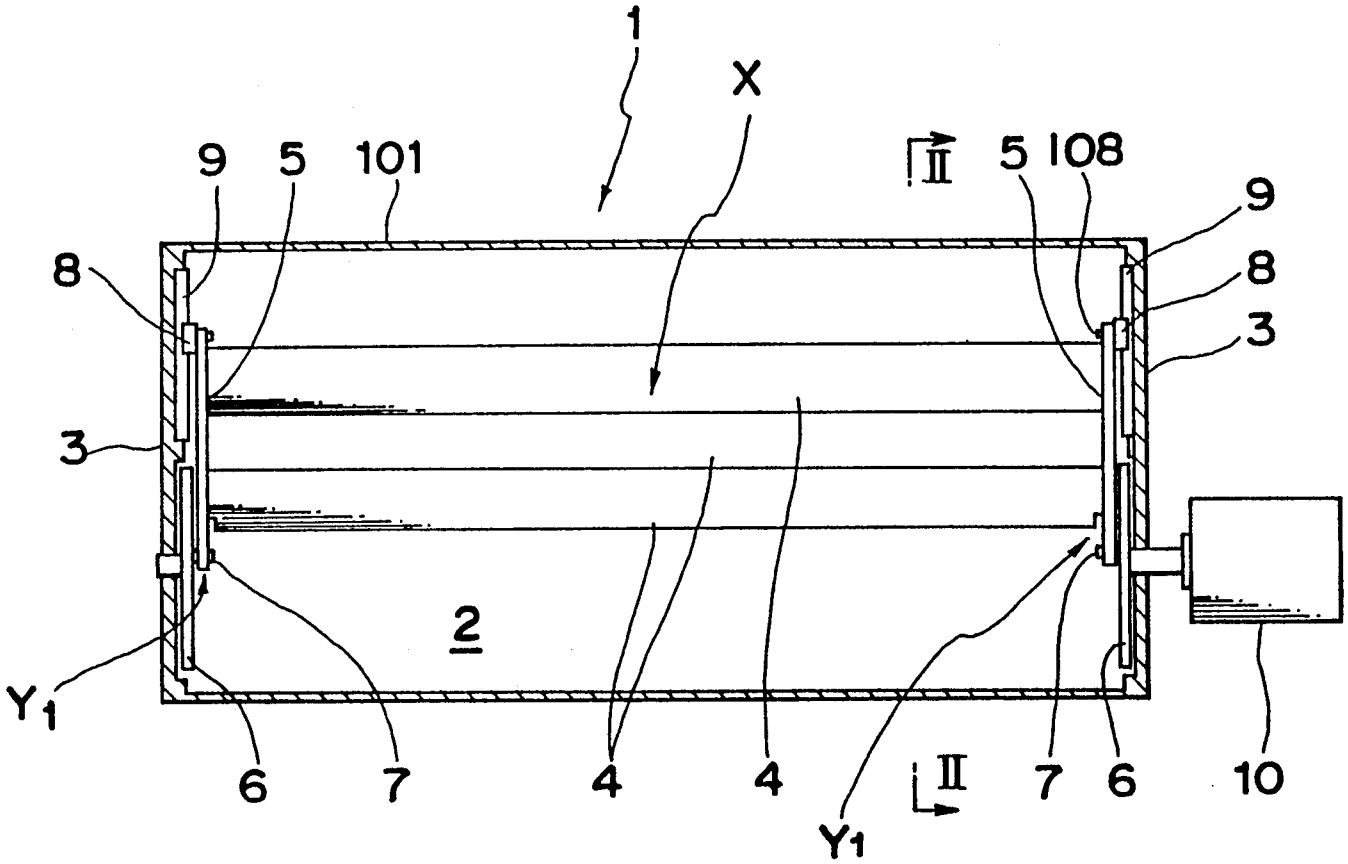
FIG. 1 is a front view of a fan according to a first embodiment of the present invention.
Figure 2:
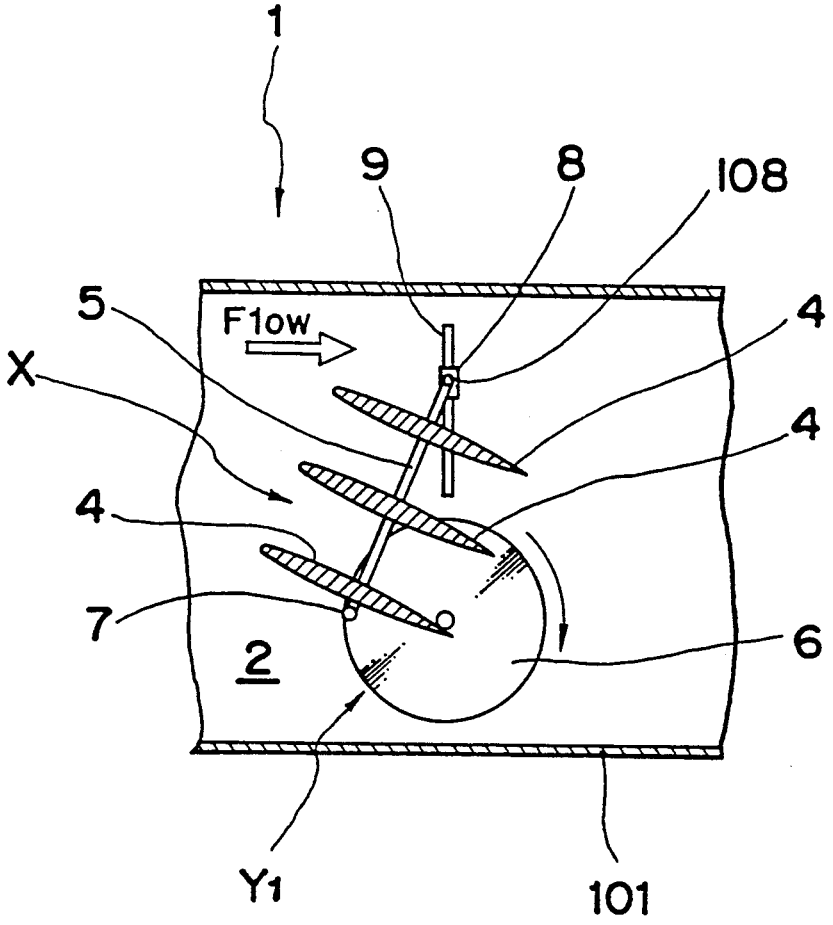
FIG. 2 is a cross sectional view taken on line II—II of FIG. 1.

In FIGS. 1 and 2, there is shown a fan 1 as a fluid transferring apparatus according to a first embodiment of the present invention. The fan 1 realizes a two-dimensional flow of a fluid with high efficiency at low level of noise by simulating a so-called Weis-Fogh mechanism. The fan is a simple mechanism which is capable of operating at high speeds. The fan 1 is provided with a wing assembly X to be described later which is arranged within a flow passage 2 of a rectangular cross section defined by a casing 101 of a rectangular cross section and, a crank mechanism Y to be described later which reciprocates each wing of the wing assembly X in a transverse direction of the flow passage while an attack angle of the wing is changed.

The wing assembly has three wings 4, 4, . . . , each with a predetermined chord length in a streamlined cross section, aligned in parallel in a thicknesswise direction of the wings with a predetermined distance therebetween. Each wing 4, 4, . . . of the wing assembly X is mounted within the flow passage 2 in a direction crossing the flow passage in a widthwise direction while both ends of the wing are supported by the crank mechanism Y1. Both surfaces of each wing 4, 4, . . . are selectively turned to be a positive pressure face and therefore, each wing is a symmetric wing having a symmetric cross section to the chord of the wing.

The crank mechanism Y1 referred to above is constituted of a disk-shaped crank 6 supported rotatably in a lower part of a side wall 3 of the flow passage 2, a slider 8 slidably supported to a guide rail 9 which extends in a vertical direction of the fan 1 in an upper part of the side wall 3 to be overlapped with the crank 6 in the vertical direction, and a link 5 of a predetermined length having one end coupled to an outer peripheral edge of the crank 6 via a crank pin 7 and the other end coupled relatively rotatably to the slider 8 by a pin 108. The rotational motion of the crank 6 is transmitted to the slider 8 via the link 5 as the reciprocal movement of the slider 8 in the vertical direction of the fan 1.

According to the first embodiment, the crank mechanism Y1 of the above-described structure is provided respectively at each side wall 3 of the flow passage 2. One crank mechanism Y1 is driven directly by a motor 10, while the other crank mechanism Y1 is driven by the one crank mechanism Y1 via the wing assembly X. Needless to say, modification to this arrangement is possible, for example, if the wing assembly is relatively long, that the crank mechanisms Y1, Y1 are synchronously driven by respective motors 10, 10 so as to lessen the force imposed on to each wing 4, 4, . . .

Right and left ends of each wing 4, 4, . . . of the wing assembly X are fixed to the links 5, 5 of the crank mechanisms Y, Y1 at the right and left side walls 3, 3 of the flow passage 2. In this case, each wing is mounted approximately with 90° to the link 5 in order that the attack angle of the wing 4 to the fluid in the flow passage 2 (i.e., transferring efficiency of the wing 4) becomes equal to each other between when the crank pin 7 is moved from a top dead point to a bottom dead point and when the crank pin 7 is moved from a bottom dead point to a top dead point.

Figure 3:
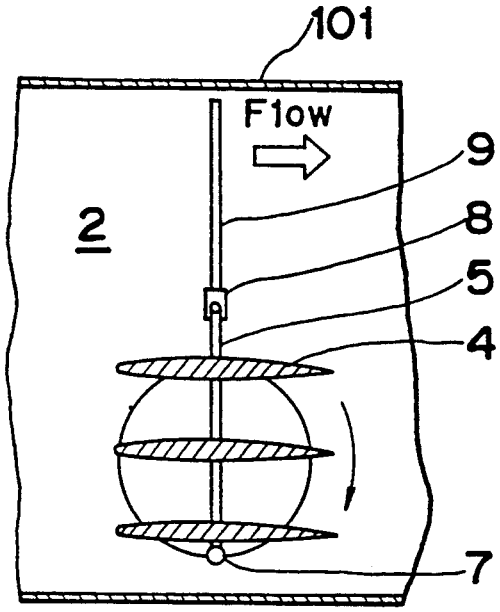
FIGS. 3–6 are explanatory diagrams of the operation of the fan of FIG. 1.

The driving state of the above fan 1 will be described with reference to FIGS. 3–6. Referring first to FIG. 3 which illustrates a first driving step, the crank pin 7 is at the bottom dead point, and each wing 4 of the wing assembly X is held in parallel to the flow of the fluid in the lower part of the flow passage 2. Therefore, the resistance to the flow by the wings 4, 4, . . . is reduced as much as possible.

Figure 4:
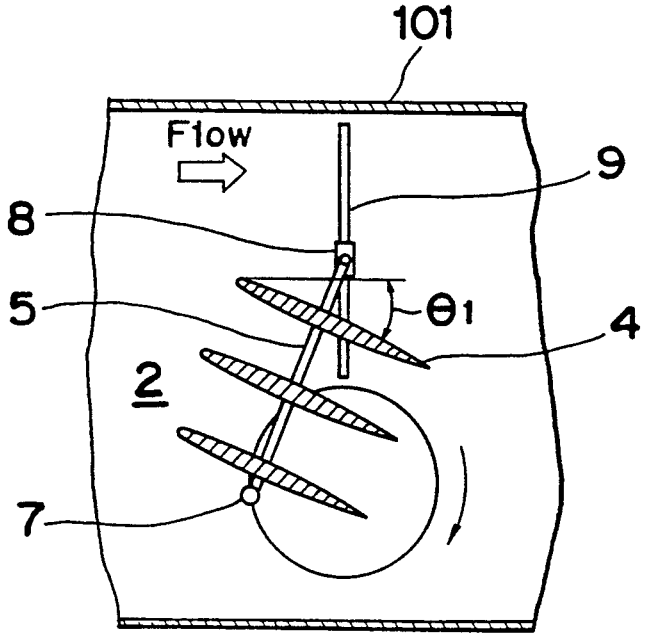
Figure 5:
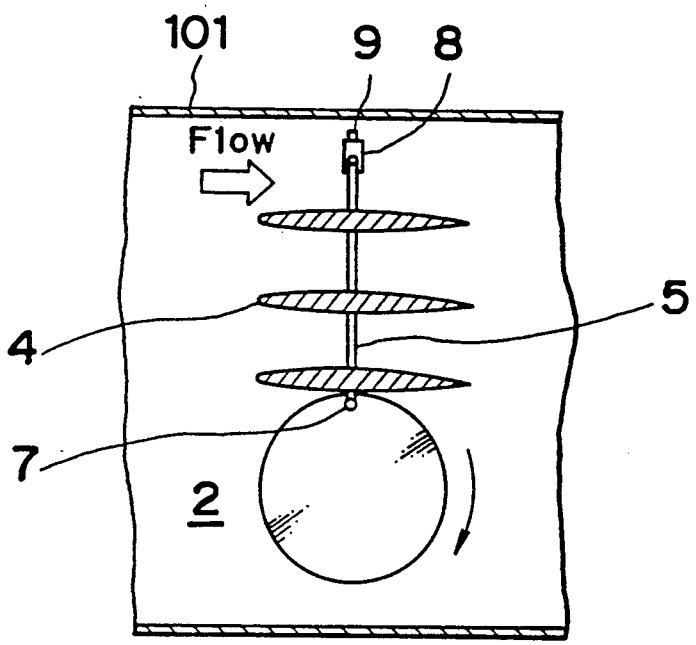
Figure 6:
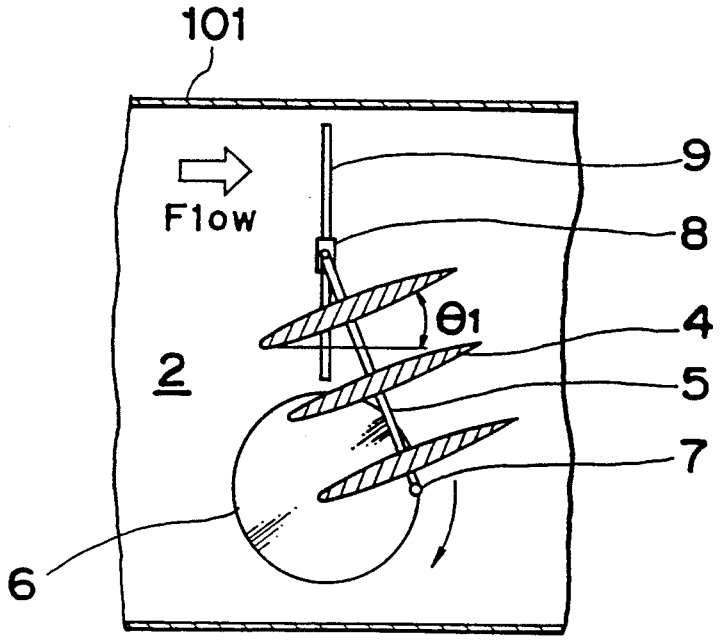

When the first step is changed to a second step shown in FIG. 4 as the crank 6 is rotated in a direction of an arrow by the motor 10, the link 5 of the crank mechanism Y1 is inclined upward in the forward direction of the flow, with the inclining angle being continuously changed. Accordingly, each wing 4 of the wing assembly X supported by this link 5 is moved to the upper part of the flow passage 2 crossing the flow passage 2 while the attack angle at the upper surface of the wing $\theta 1$ is continuously changed. In consequence, the air is transferred. This feeding action of the air is continued until the crank pin 7 reaches a top dead point in a third step (referring to FIG. 5). When the crank pin 7 reaches the top dead point, the feeding action by the wing is stopped. However, each wing is turned in parallel to the flow in the flow passage 2 and therefore gives little resistance to the flow of the air obtained so far. Accordingly, the pulsation in the air flow is prevented as much as possible.

When the crank 6 is further rotated and the crank pin 7 is moved from the top dead point to the bottom dead point in a fourth step (referring to FIG. 6), the link 5 of the crank mechanism Y1 is inclined downward in the forward direction of the flow and the inclining angle of the link 5 is continuously changed. As a result, each wing 4 of the wing assembly X is moved downward while the attack angle at the lower surface of the wing $\theta 1$ is continuously changed, thereby performing a transfer of the air. The air is kept feeding until the crank pin 7 is returned to the bottom dead point again (referring to FIG. 3).

As the wings of the wing assembly X are reciprocated by the crank mechanisms Y1, Y1 in the vertical direction within the flow passage 2 while the attack angles of the wings are continuously changed as described hereinabove, the continuous transfer of the air is thus achieved.

Figure 7:
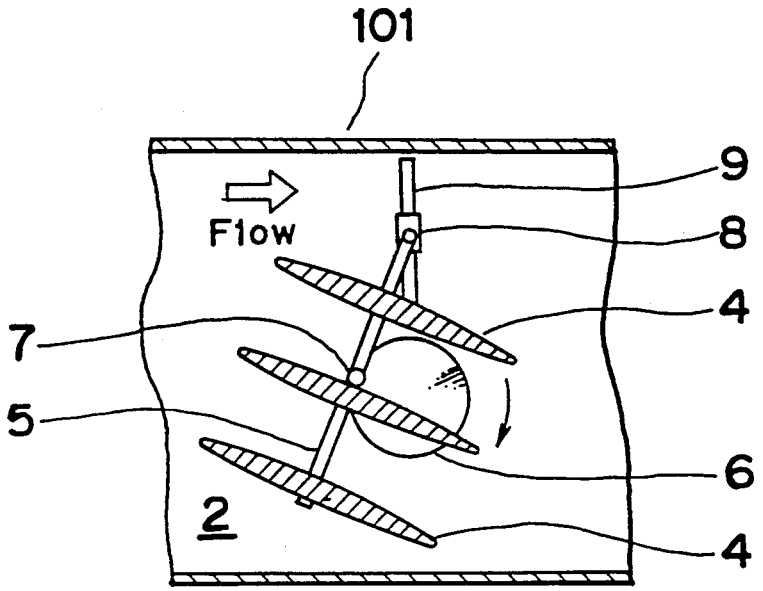
FIG. 7 is a cross sectional view of a modified example of the fan of FIG. 1.

FIG. 7 shows a modified embodiment of the fan 1 of FIG. 1. More specifically, as compared with the first embodiment wherein the crank pin 7 is provided at one end of the link 5, the crank pin 7 is set in the middle of the link 5 in this modified embodiment. In the structure of FIG. 7, if the oscillating angle of the link 5 is the same as in FIG. 1, the crank 6 becomes smaller in diameter, so that the fan 1 can be made compact in size.

Second Embodiment

Figure 8:
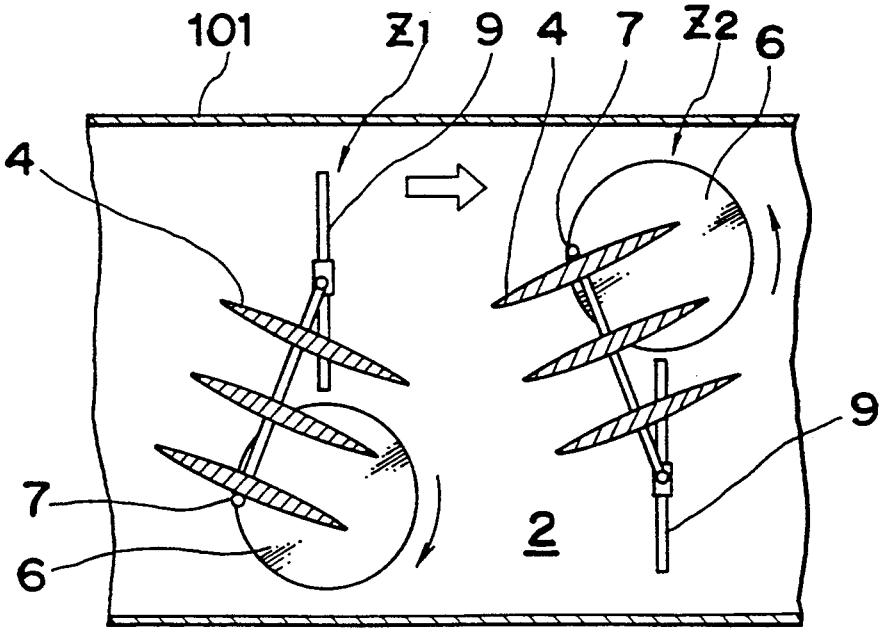
FIG. 8 is a cross sectional view of a fan according to a second embodiment of the present invention.

FIG. 8 is a cross sectional view of a fan 1 according to a second embodiment of the present invention. Although one unit of the wing assembly X and crank mechanism Y1 coupled to the wing assembly X (referred to as a fan unit hereinafter) is provided in the first embodiment, there are provided two fan units Z1, Z2 at both the upstream and the downstream sides of the flow passage 2 in the second embodiment. These fan units Z1, Z2 are mounted reverse to each other in the vertical direction and rotated in the reverse phase.

In the above-described structure, since the air is fed by two fan units Z1, Z2, i.e., the air is pressured in two stages, a larger static pressure is obtained, as compared with the case that only one fan unit is used. Moreover, since the two units Z1, Z2 are rotated reverse in phase, the pulsation in the air flow is more restricted, thereby realizing a stable flow of the air.

Figure 9:
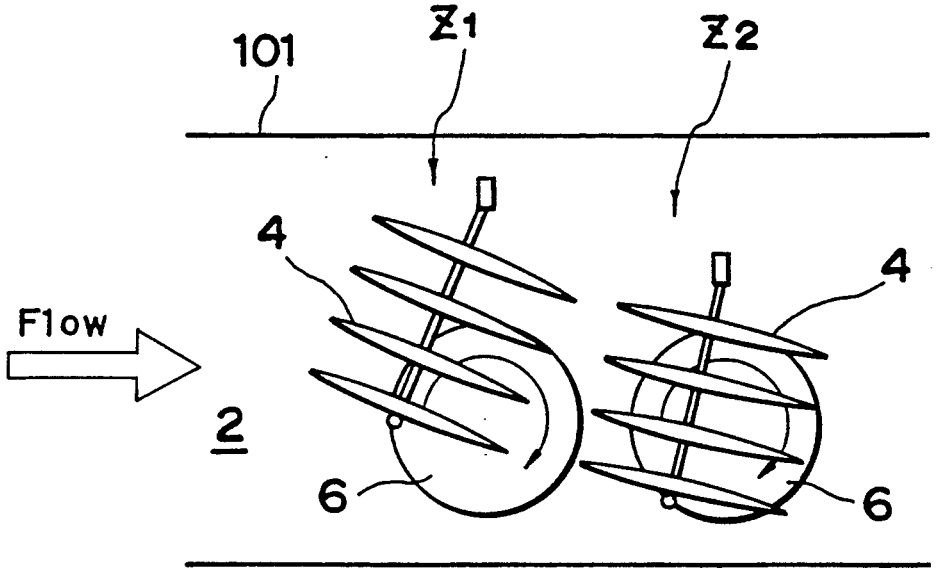
FIG. 9 is a cross sectional view of a modification of the fan of FIG. 8.

FIG. 9 is a modified example of FIG. 8, wherein two fan units Z1, Z2 are arranged in the same vertical direction (i.e., two or more pairs of the fan unit of the first embodiment are arranged with a predetermined distance). The rotational direction is made the same, but the rotational phase difference is suitably set. Accordingly, the pulsation in the air flow is restrained and the static pressure is kept large.

Third Embodiment

Figure 10:
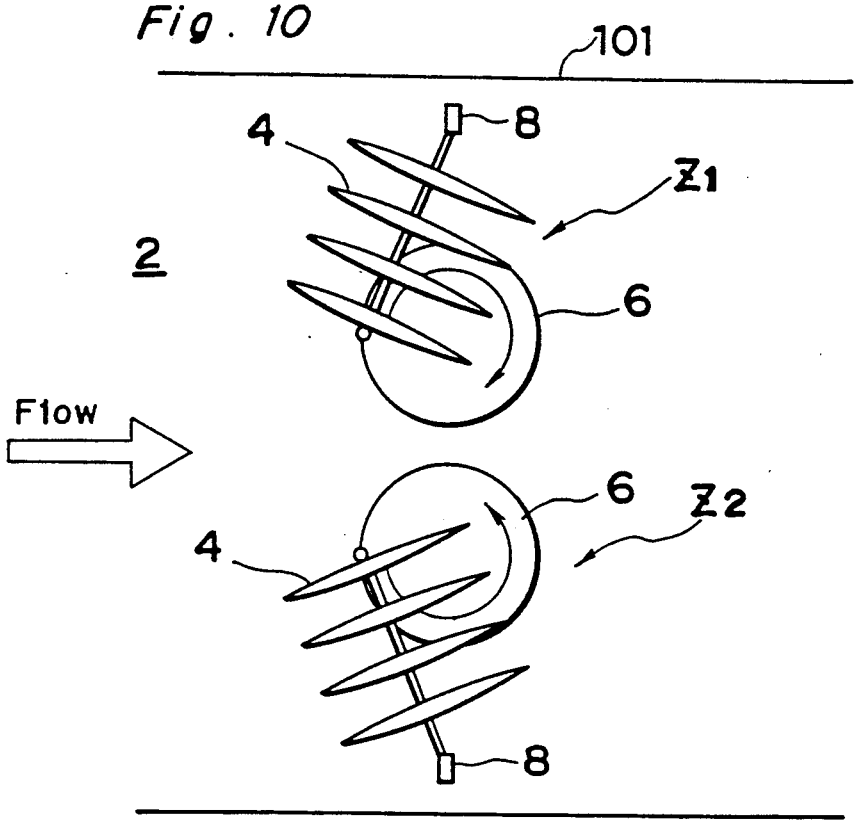
FIG. 10 is a cross sectional view of a fan according to a third embodiment of the present invention.

A fan of a third embodiment of the present invention is, as indicated in FIG. 10, so constituted that two fan units Z1, Z2 are provided up and down to traverse the flow passage 2. The fan units Z1, Z2 are symmetric to a direction of the air flow. The cranks 6, 6 adjacent to each other are driven in the reverse direction, that is, in the reverse phase, thereby to transfer the air. Accordingly, the transferring amount of the air is increased.

Figure 11:
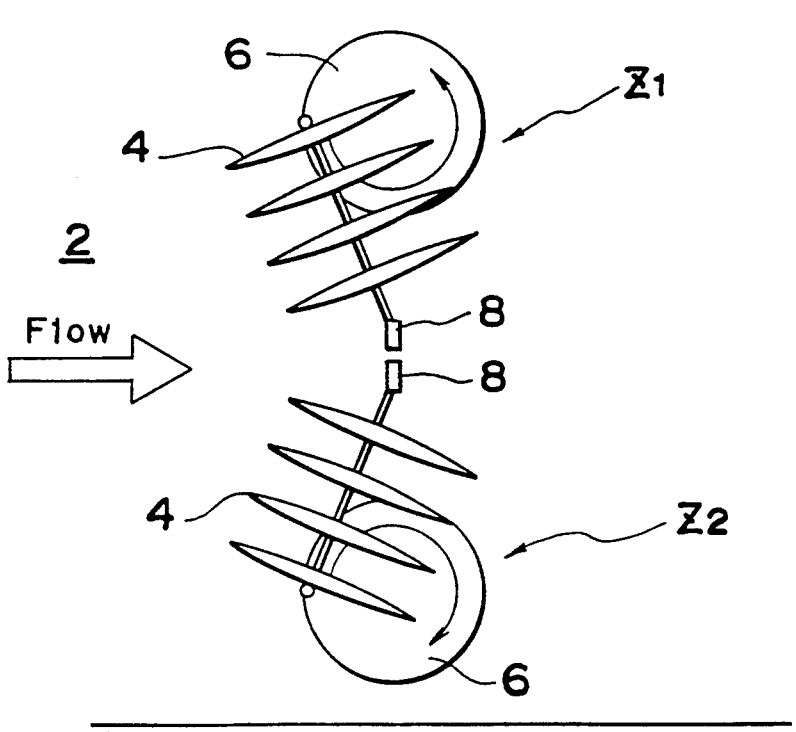
FIGS. 11 and 12 are cross sectional views of modifications of the fan of FIG. 10.

FIG. 11 is a modification of the fan of FIG. 10, which is different from FIG. 10 in that the sliders 8, 8 are provided adjacent to each other.

Figure 12:
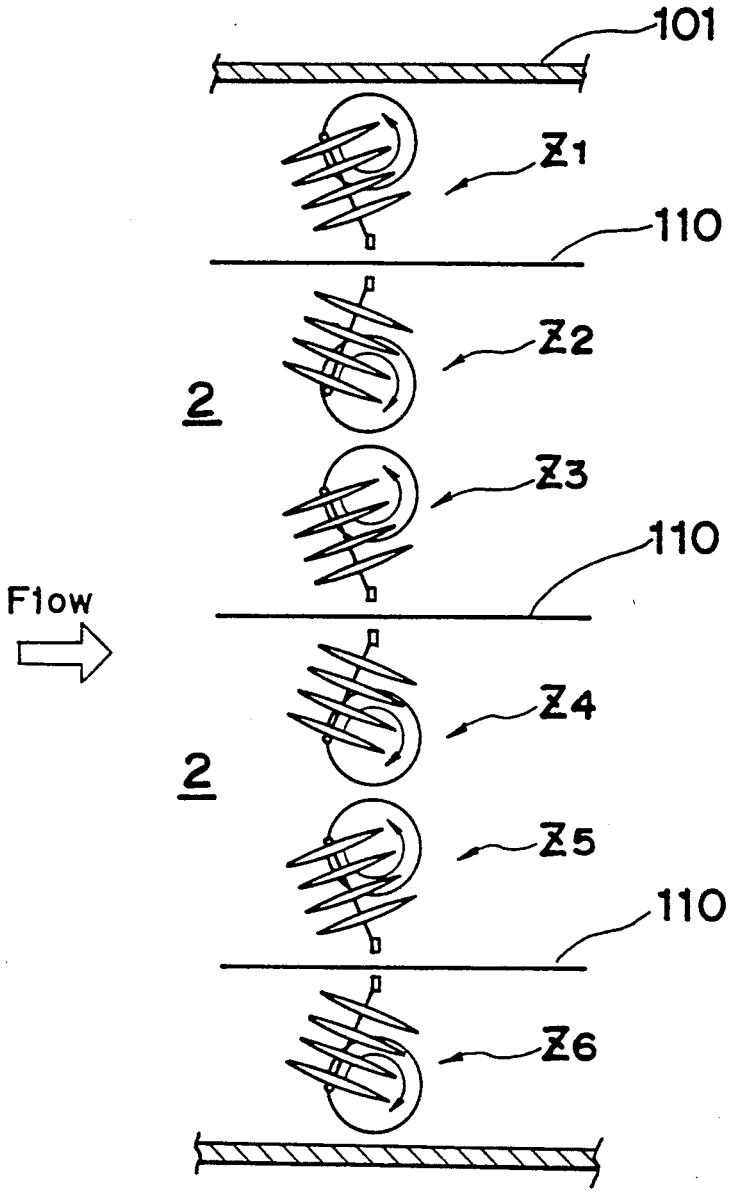

In a further modification shown in FIG. 12, there are six fan units Z1, Z2, Z3, . . . Z6 provided in a transverse direction of the flow passage 2. The adjacent two fan units are symmetric to each other to the flow of the flow passage 2, and driven in the reverse phase. A numeral 110 designates a flow rectifier plate.

Fourth Embodiment

Figure 13:
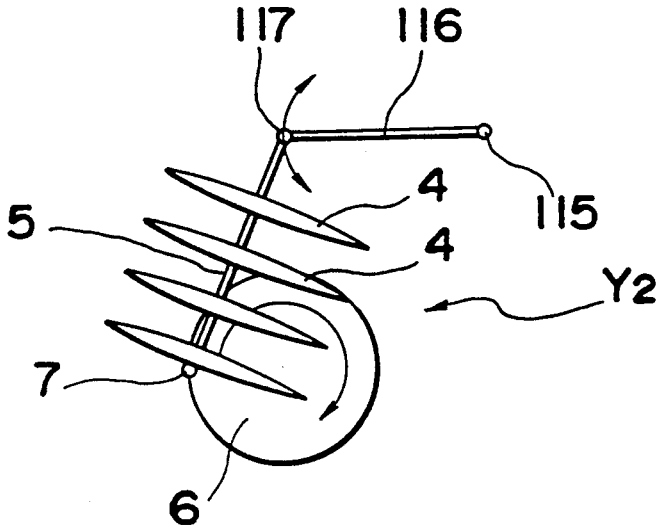
FIG. 13 is a cross sectional view of a fan according to a fourth embodiment of the present invention.

A fan according to a fourth embodiment of the present invention is shown in FIG. 13. A crank mechanism Y2 of FIG. 13 is constituted of a crank 6, a crank pin 7, a first link 116 mounted rotatably to a fulcrum 115 and a second link 5 having one end thereof rotatably mounted to the crank pin 7 and the other end thereof rotatably provided to an end of the first link 116 by a pin 117.

The crank mechanism Y2 operates as a quadric crank chain.

Fifth Embodiment

Figure 14:
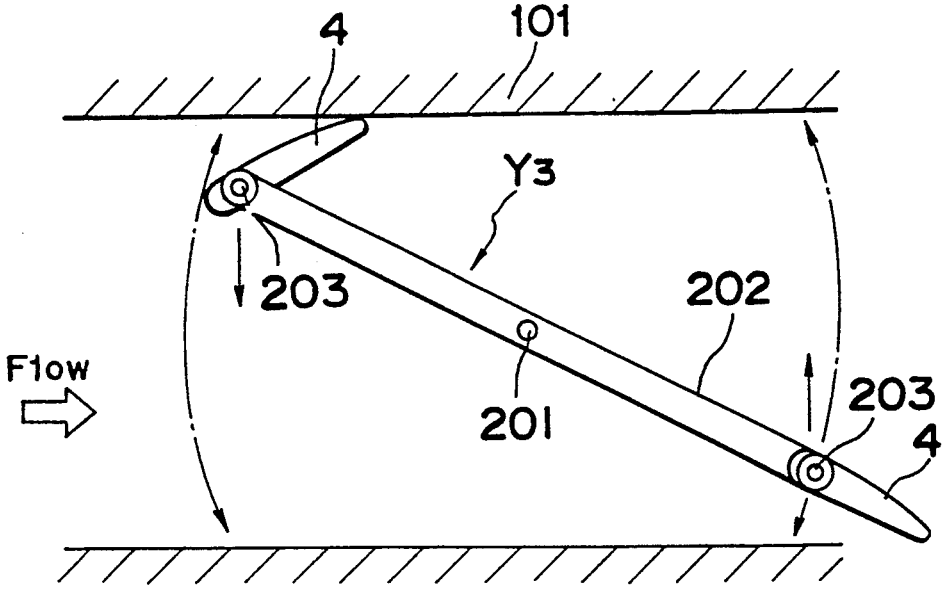
FIG. 14 is a cross sectional view of a fan according to a fifth embodiment of the present invention.

In a fifth embodiment of a fan shown in FIG. 14, a driving mechanism Y3 is comprised of a shaft 201 extending in a direction intersecting the flow passage 2 and a lever 202. The lever 202 is swayed at its center around the shaft 201 by a swing motor (not shown), although it is possible to swing the lever 202 by a crank mechanism, as described later. A front end part of each wing 4 is mounted to each end of the lever 202 by a pin 203, so that the wing 4 is rotated when receiving a predetermined force which is set, for instance, by adjusting the friction force between the pin 203 and wing 4.

Figure 15:
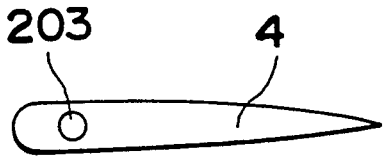
FIGS. 15 and 16 are explanatory diagrams of the fan of FIG. 14.
Figure 16:
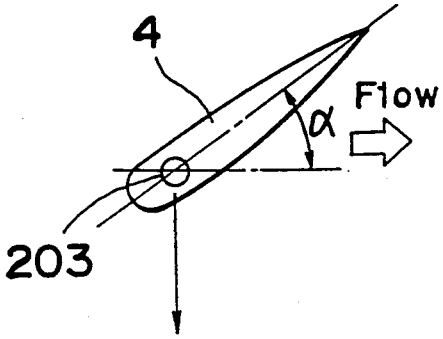

The swinging motion of the lever 202 causes the wings 4, 4 to move similarly to the flapping bees. Concretely, with reference to FIGS. 15 and 16, when the pin 203 is moved downward, the horizontal wing 4 receives a repulsive force from the fluid thereby to rotate upwards, and vice versa.

Figure 17:
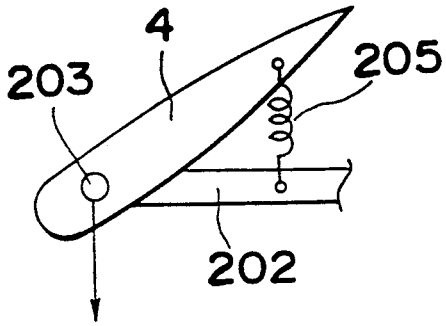
FIGS. 17 and 18 are diagrams of modifications of the fan of FIG. 14.

FIG. 17 is a modified example of FIG. 14, in which a rear end of the wing 4 is coupled to the lever 202 by a coil spring 205 so that the attack angle of the wing 4 is held within 30°. The attack angle may be within 45°. In addition, a frond end or a center part of the wing 4 may be coupled to the lever 202 by a coil spring, although it is not in figures.

Figure 18:
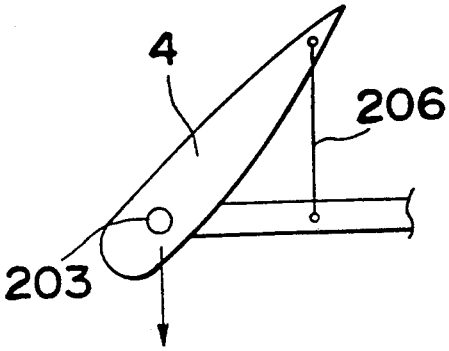

In FIG. 18, the coil spring 205 of FIG. 17 is replaced with a leader 206.

Sixth Embodiment

Figure 19:
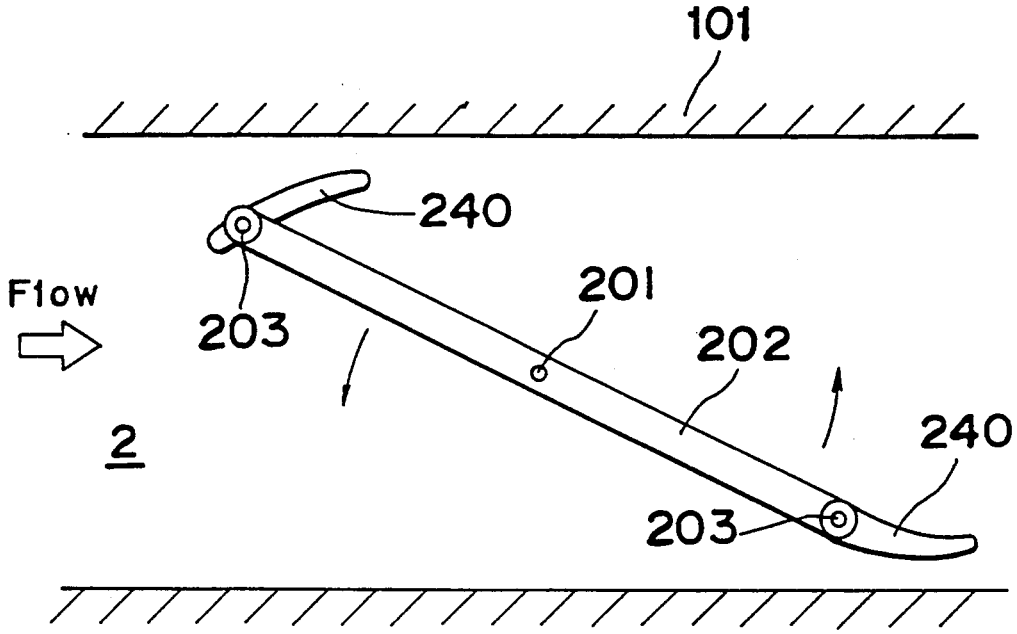
FIG. 19 is a cross sectional view of a fan according to a sixth embodiment of the present invention.

According to a sixth embodiment of a fan of FIG. 19, a wing 240 is formed of flexible material, and this is a sole difference from FIG. 14. When the lever 202 is rotated in a direction of an arrow, the wing 240 is bent as shown in FIG. 19 since it is formed of flexible material.

Figure 20:
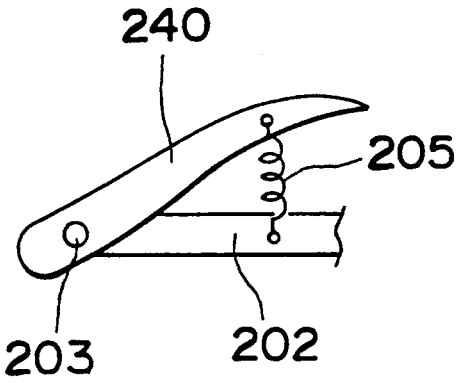
FIGS. 20 and 21 are explanatory diagrams of modifications of the fan of FIG. 19.
Figure 21:
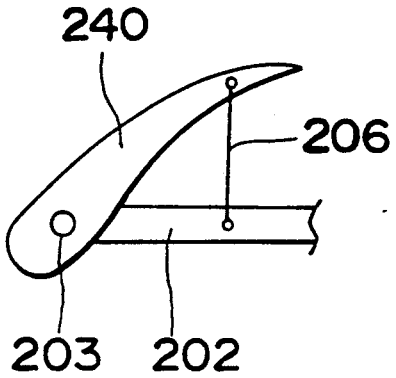

In FIGS. 20 and 21, the wing 4 of FIGS. 17 and 18 is replaced with a flexible wing 240, respectively.

Seventh Embodiment

Figure 22:
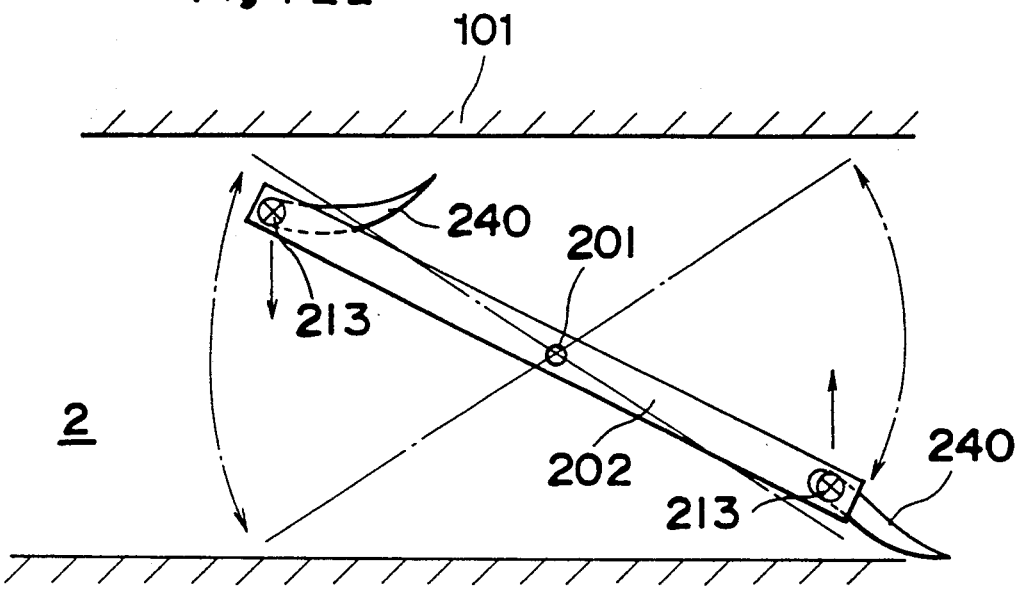
FIG. 22 is a cross sectional view of a fan according to a seventh embodiment of the present invention.

As indicated in FIG. 22, according to a seventh embodiment of the present invention, each wing 240 is formed of flexible material, a front end part of which is rigidly fixed to an end of the lever 202 by a fixing pin 213 in a manner not to be rotatable. In the natural state, the wings 240 extend along the center line of the lever 202 and moreover, rear end parts of the wings 240 are directed in the same downstream direction.

Figure 23:
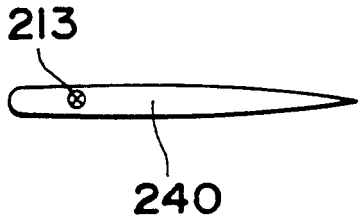
FIGS. 23 and 24 are explanatory diagrams of the fan of FIG. 22.
Figure 24:
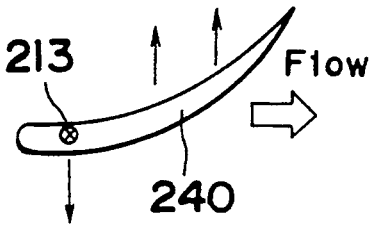

As the lever 202 is swung, the wings 240 are moved in a manner similar to when the bees are flapping. That is, referring to FIGS. 23 and 24, when the horizontal wing 240 is moved downward, it receives a repulsive force from the fluid and is accordingly rotated upward as indicated in FIG. 24. The same, is true if the wing 240 is moved in the opposite direction.

Figure 25:
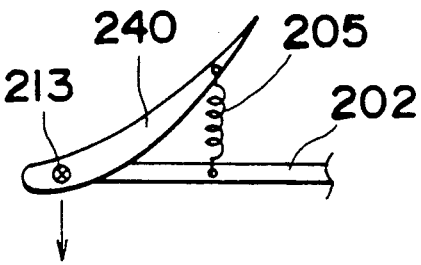
FIGS. 25 and 26 are diagrams of modifications of the fan of FIG. 22.

FIG. 25 is a modification of FIG. 22, wherein a rear end of the wing 240 and the lever 202 are coupled with each other by a coil spring 205, so that the attack angle of the wing 240 is kept within 30°. However, the attack angle of the wing 240 may be held within 45°.

Figure 26:
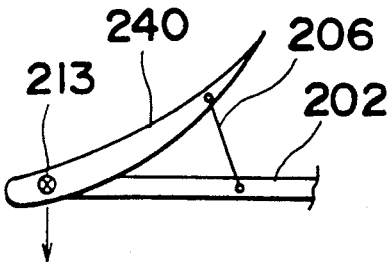

Further in FIG. 26, the coil spring 205 of FIG. 25 is replaced with a leader 206.

Further, alternatively, a front end or a center part of the wing 260 may be coupled to the lever 202 by either a coil spring or a leader.

Eighth Embodiment

Figure 27:
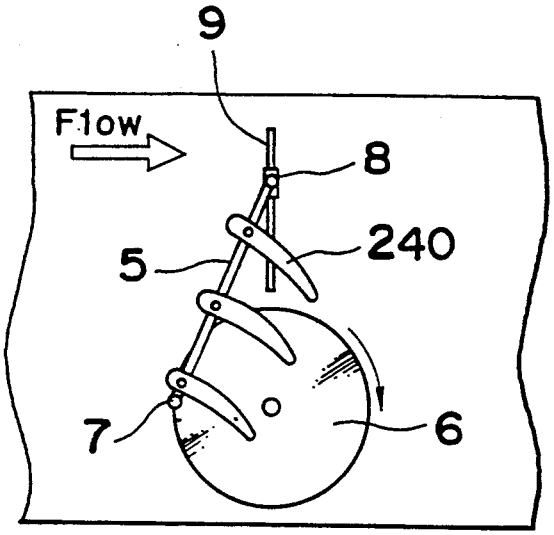
FIG. 27 is a cross sectional view of a fan according to an eighth embodiment of the present invention.

FIG. 27 represents an eighth embodiment of the present invention. The eighth embodiment is different from the first embodiment of FIGS. 1 and 2 only in that a front end part of the wing 240 made of flexible material is fixed to the link 5.

Ninth Embodiment

Figure 28:
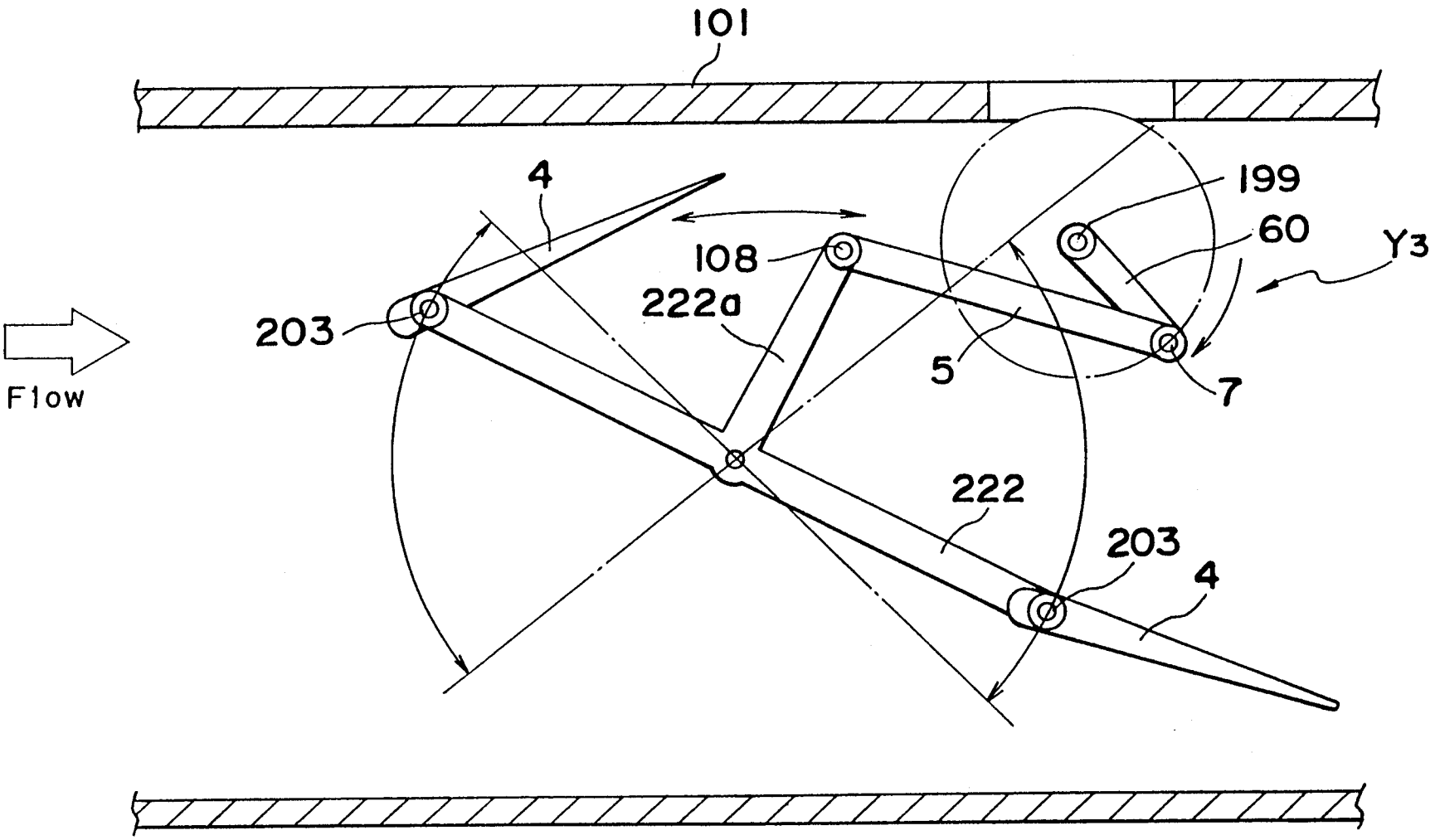
FIG. 28 is a cross sectional view of a fan according to a ninth embodiment of the present invention.

Referring to FIG. 28, a T-shaped lever 222 of a fan according to a ninth embodiment of the present invention has a projecting part 222*a* which projects in a direction perpendicular to the central part of the lever 222. A crank mechanism Y3 consists of the T-shaped lever 222, a rotary crank 60, a crank pin 7 and a link 5. One end of the link 5 is rotatably mounted to the crank pin 7, while the other end of the link 5 is rotatably mounted to a front end of the projecting part 222*a* of the lever 222 by a pin 108. The crank mechanism Y3 operates in the same manner as in the fifth embodiment shown in FIGS. 14–16.

Figure 30:
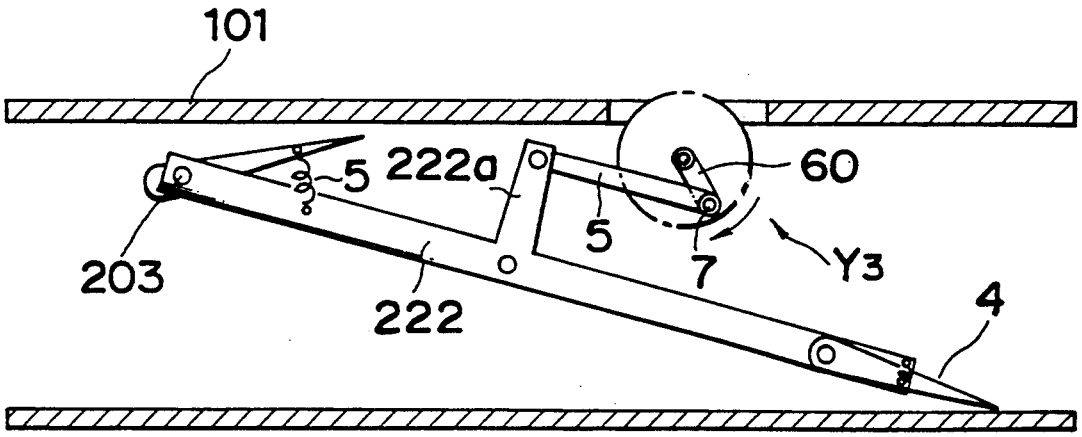
FIGS. 29 and 30 are a front view and a cross sectional view of a modification of the fan of FIG. 28.
Figure 29:
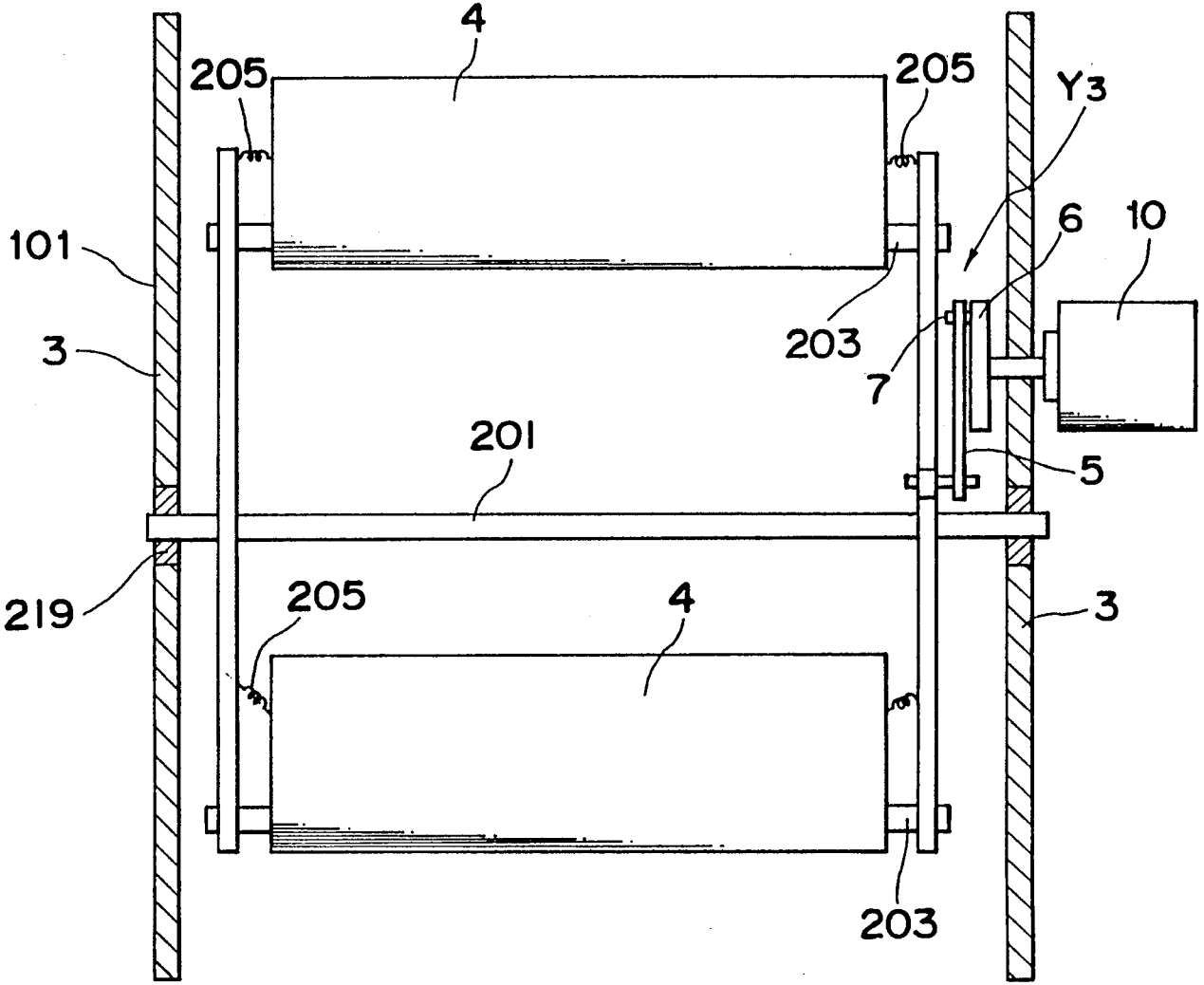

In a modified embodiment of FIGS. 29 and 30, a coil spring 205 is utilized so as to control the attack angle of the wing 4. A reference numeral 219 in FIG. 29 denotes a bearing which supports a shaft 201.

Tenth Embodiment

Figure 31:
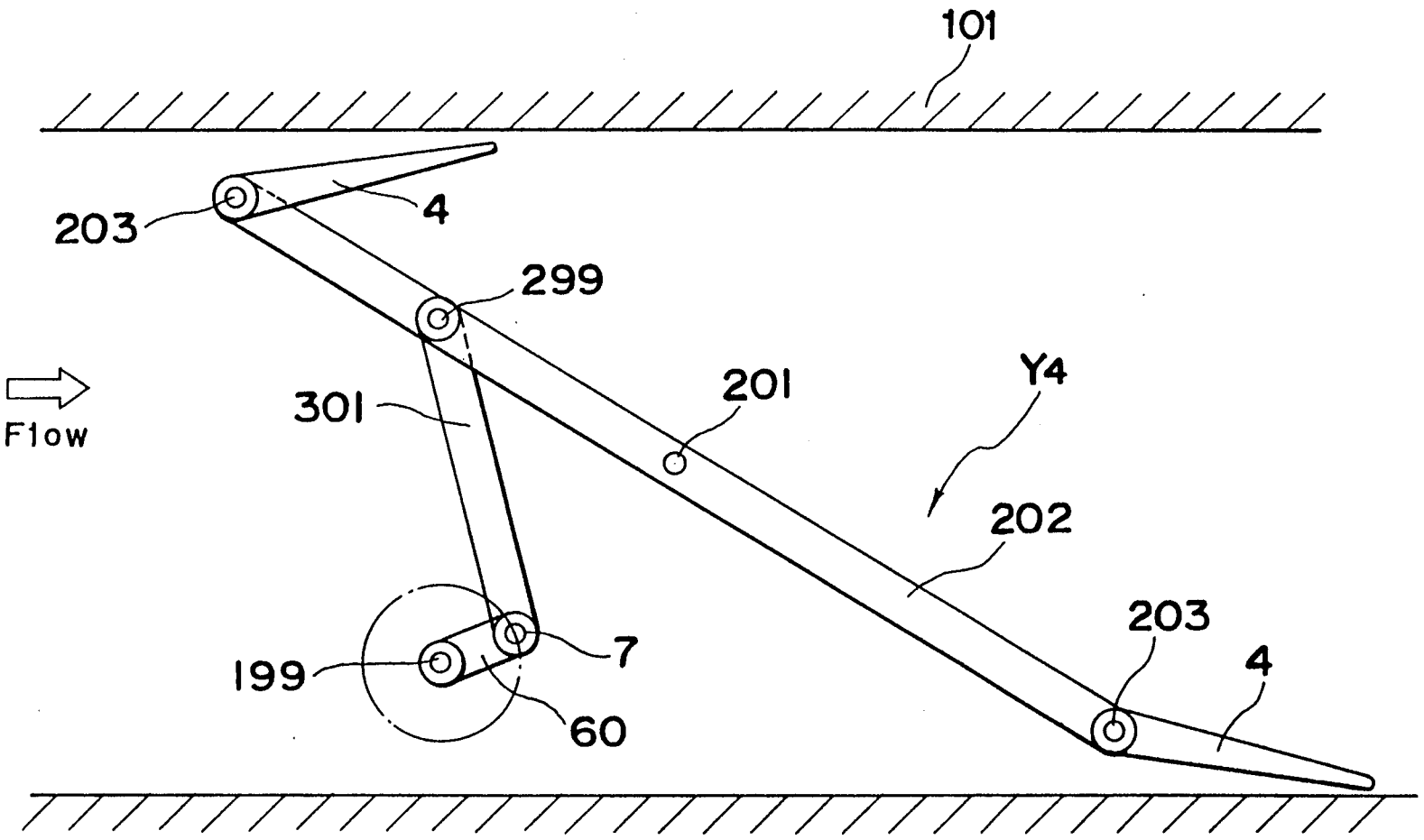
FIG. 31 is a cross sectional view of a fan according to a tenth embodiment of the present invention.

According to a tenth embodiment shown in FIG. 31, the wing 4 is allowed to flap like bees by a crank mechanism Y4. The crank mechanism Y4 is comprised of a lever 202 supported at a fulcrum 201 in a swinging fashion, a crank 60, a crank pin 7 and a link 301 with one end rotatably mounted to the crank pin 7 and the other end rotatably mounted at the intermediate point between a front end and the center of the lever 202 by a pin 299. The operation of the crank mechanism Y4 is the same as the crank mechanism Y3 in the fifth embodiment shown in FIGS. 14–16.

Figure 32:
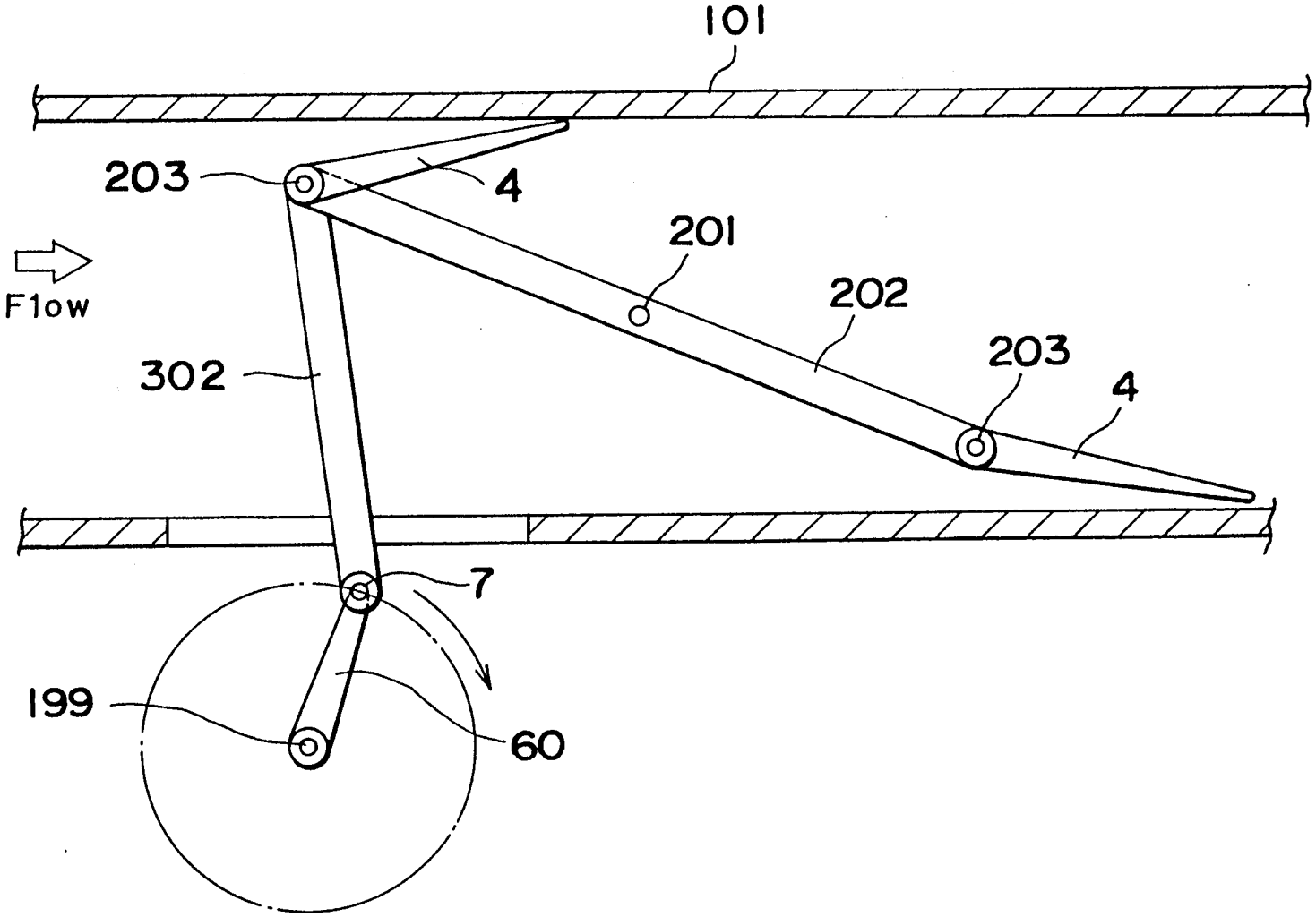
FIG. 32 is a cross sectional view of a variation of the fan of FIG. 31.

FIG. 32 is a modification of FIG. 31. An end of a link 302 is coupled to an end of the lever 202 by a pin 203 so as to prevent the end of the lever 202 from oscillating. Also, the crank 60 is disposed outside the casing 101 so as to reduce resistance against a flow.

Eleventh Embodiment

Figure 33:
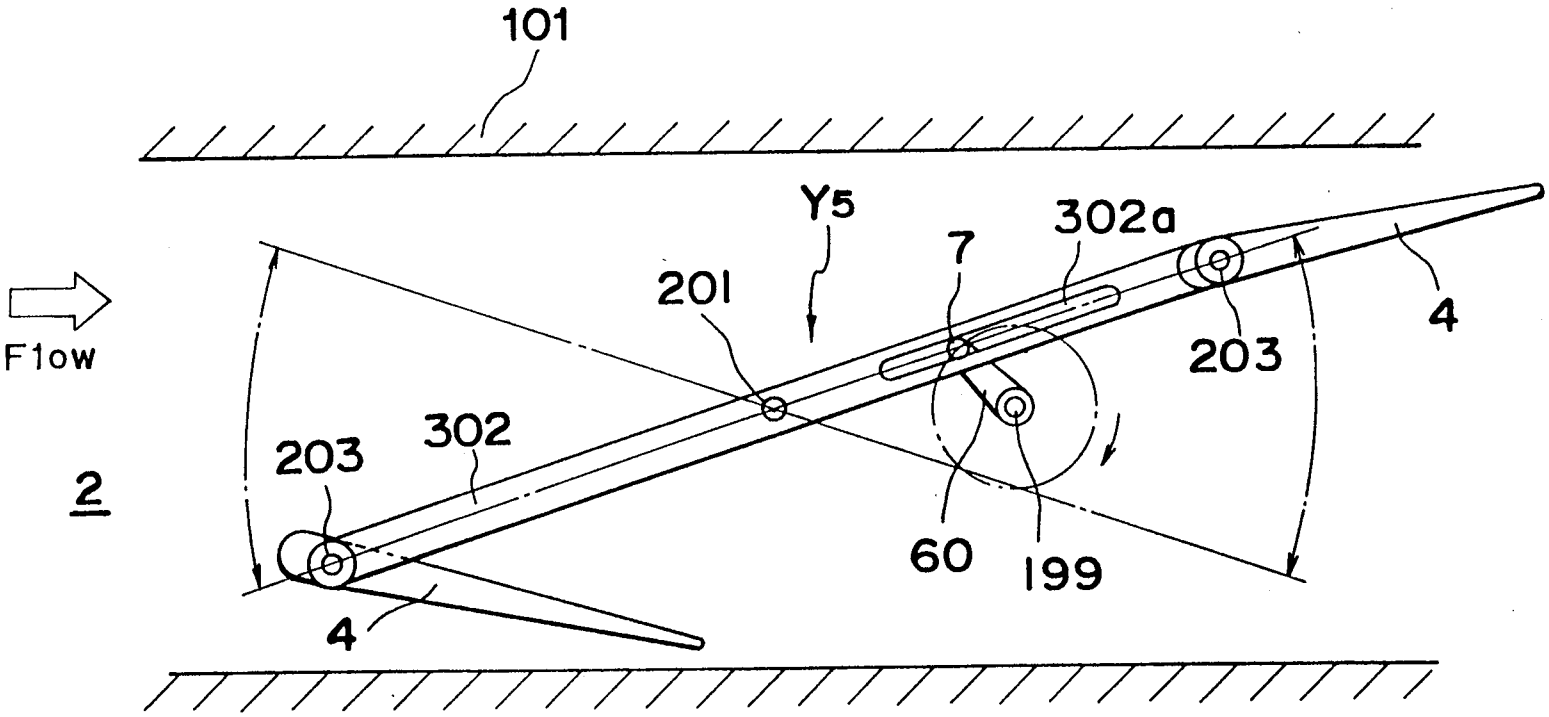
FIG. 33 is a cross sectional view of a fan according to an 11th embodiment of the present invention.

As shown in FIG. 33, a crank mechanism Y5 of a fan according to an 11th embodiment of the present invention is comprised of a lever 302 having a groove 302*a* and swinging at a fulcrum 201, a rotating crank 60, and a crank pin 7 sliding in the groove 302*a* of the lever 302. The wings 4 are moved in such a manner as if bees were flapping.

Although the wing assembly X is constituted of two or three sheets of wings 4, 4, . . . in any of the foregoing embodiments, the present invention is not restricted to this number of wings, and the number of wings may be set suitably corresponding to the desired transferring amount of air or static pressure, etc. It is needless to say that the wing assembly X may be formed of four or more wings, or a single wing sheet of may be provided at either of the upstream and downstream sides of the lever. Moreover, the chord length of the wing may be set suitably.

The fluid transferring apparatus of the present invention is embodied in fan in the description hereinabove. However, the present invention is applicable, for example, to a pump or the like.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid transferring apparatus comprising:

a casing defining a flow passage for fluid;

a wing assembly having at least one wing provided in a transverse direction of the flow passage; and a driving mechanism for moving the at least one wing, the driving mechanism comprises a crank mechanism with a rotating crank, a crank pin, a guide member, a slider and a link, the guide member extends in the transverse direction of the flow passage, the slider is guided by the guide member to slide in the transverse direction of the flow passage, the link has one end thereof rotatably coupled to the crank pin and the other end thereof rotatably coupled by a pin to the slider, the at least one wing of the wing assembly being mounted to the link of the crank mechanism.

2. The fluid transferring apparatus as set forth in claim 1, wherein the casing and the flow passage are generally rectangular in cross section.

3. The fluid transferring apparatus as set forth in claim 1, wherein the driving mechanism is provided in the vicinity of the casing and in a peripheral section of the flow passage.

4. The fluid transferring apparatus as set forth in claim 1, wherein the at least one wing of the wing assembly is fixed to the link.

5. The fluid transferring apparatus as set forth in claim 1, wherein the wing assembly has a plurality of wings which are generally parallel to each other and are fixed to the link.

6. The fluid transferring apparatus as set forth in claim 5, wherein the at least one wing is formed of flexible material, a front end of the at least one wing being fixed to the link.

7. The fluid transferring apparatus as set forth in claim 1, wherein a front end of the at least one wing is rotatably mounted to the link in a manner that a predetermined force is necessary to rotate the wing relative to the link.

8. The fluid transferring apparatus as set forth in claim 1, wherein a front end of the at least one wing is rotatably mounted to the link by a pin, while the at least one wing is coupled to the link by a spring, thereby an angle of attack of the wing is controlled.

9. The fluid transferring apparatus as set forth in claim 1, wherein a front end of the at least one wing is rotatably mounted to the link by a pin, while the at least one wing is coupled to the link by a leader, thereby an angle of attack of the wing is controlled.

10. The fluid transferring apparatus as set forth in claim 1, wherein a plurality of units each comprised of the crank mechanism and wing assembly are provided at both the upstream and the downstream sides of the flow passage, with rotational phase angles being made different among the cranks of the crank mechanism in the plurality of units when the cranks are driven.

11. The fluid transferring apparatus as set forth in claim 1, wherein a plurality of units each comprised of the crank mechanism and wing assembly are provided in the transverse direction of the flow passage.

12. The fluid transferring apparatus as set forth in claim 11, wherein the units adjacent to each other are arranged in a generally symmetric relation and are driven in reverse rotational phase.

13. A fluid transferring apparatus as set forth in claim 1, wherein the at least one wing is formed of flexible material.

14. A fluid transferring apparatus which comprises:

a casing defining a flow passage for fluid;

a wing assembly having at least one wing provided in a transverse direction of the flow passage; and a driving mechanism for moving the at least one wing, the driving mechanism comprises a crank mechanism having a crank, a crank pin, a first link, and a second link, the first link being rotatably mounted at a fulcrum and the second link having one end thereof rotatably mounted to the crank pin and the other end thereof rotatably mounted to an end of the first link by a pin, and wherein the at least one wing of the wing assembly is mounted to the second link.

15. A fluid transferring apparatus which comprises:

a casing defining a flow passage for fluid;

a wing assembly having at least one wing provided in a transverse direction of the flow passage; and a driving mechanism for moving the at least one wing, the driving mechanism comprises a swinging lever mounted to a shaft extending in a direction to traverse the flow passage, a front end of the at least one wing of the wing assembly is rotatably mounted to the lever the at least one wing is coupled to the lever by a leader, thereby an angle of attack of the wing is controlled.

16. A fluid transferring apparatus as set forth in claim 15, wherein the at least one wing is formed of flexible material.

* * * * *